US005433442A

United States Patent [19]

Walker

[11] Patent Number: 5,433,442

[45] Date of Patent: Jul. 18, 1995

[54] GOLF CLUBS WITH QUICK RELEASE HEADS

[76] Inventor: Brian S. Walker, 22903 Katzman, Clinton Township, Mich. 48035

[21] Appl. No.: 209,299

[22] Filed: Mar. 14, 1994

[51] Int. Cl.[6] ..... A63B 53/02; A63B 53/16

[52] U.S. Cl. ..... 273/80.2; 273/80 D; 273/80.8

[58] Field of Search ..... 273/80.1, 80.2, 80.3, 273/80.4, 80.5, 80.6, 80.7, 80.8, 80.9, 77 R, 167 R, 79, 168, 80 D

[56] References Cited

U.S. PATENT DOCUMENTS

| | | | |
|---|---|---|---|
| 1,697,846 | 1/1929 | Anderson | 273/81.2 |
| 2,051,961 | 8/1936 | Mears | 273/80.1 |
| 3,170,691 | 2/1965 | Pritchard | 273/80.5 |
| 3,829,092 | 8/1974 | Arkin | 273/80.1 |
| 4,597,577 | 7/1986 | Lamanna | 273/80.1 |
| 4,895,368 | 1/1990 | Geiger | 273/80.1 |
| 5,083,779 | 1/1992 | Ungermann | 273/81.2 |

FOREIGN PATENT DOCUMENTS

| | | | |
|---|---|---|---|
| 26280 | of 1912 | United Kingdom | 273/80.2 |
| 332354 | 7/1930 | United Kingdom | 273/80.3 |
| 442405 | 2/1936 | United Kingdom | 273/80.4 |

*Primary Examiner*—Sebastiano Passaniti

[57] ABSTRACT

A golf club with a quick release head comprising a shaft which has an upper handle end a lower hosel end formed in a tubular configuration. The hosel end has a bore centrally formed therein. Screw threads formed within the bore extend from the hosel end of the shaft inwardly a predetermined distance. A head at the lower head end has an upwardly extending hosel at the hosel end and a bore formed within the hosel end. The interior diameter of the bore of the hosel is essentially the same as the internal bore in the shaft and the exterior diameter of the hosel is essentially the same as the exterior diameter of the shaft at the hosel end. The hosel has a diametric aperture which extends therethrough. A coupling rod has a threaded upper end with screw threads matable with the screw threads in the bore of the shaft and a lower end formed with a diametric aperture extends therethrough in alignment with the diametric aperture in the hosel. A quick release pin is positionable through the apertures of the hosel and rod to secure a preselected head in operative association with the rod and shaft.

4 Claims, 3 Drawing Sheets

FIG. 5
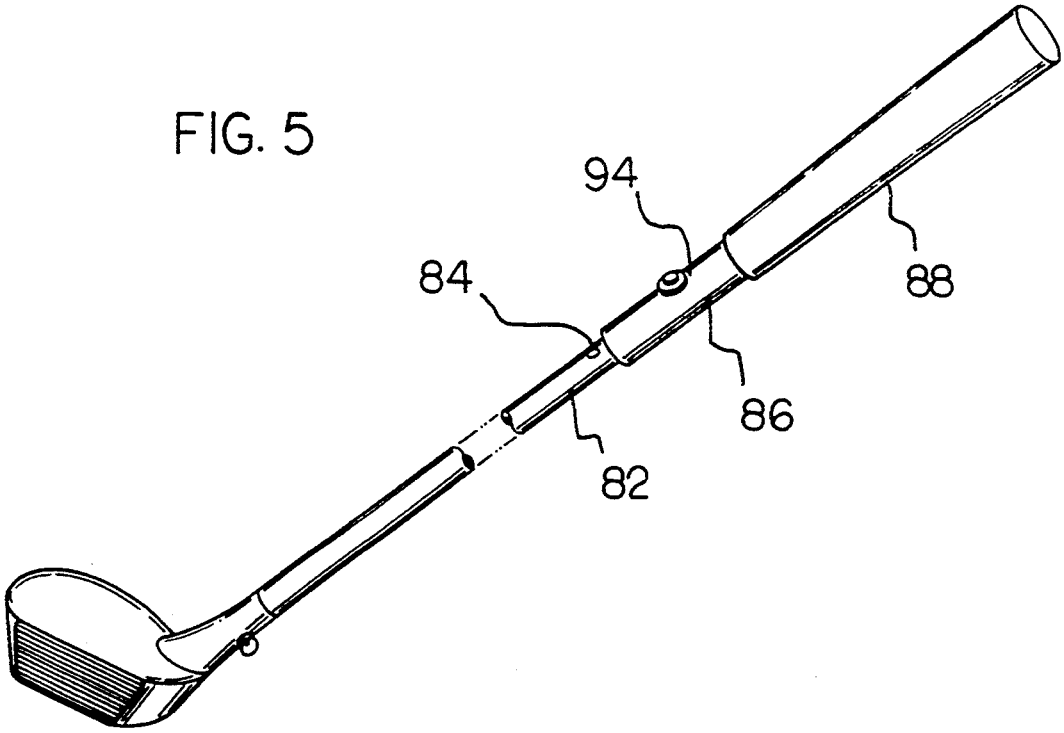
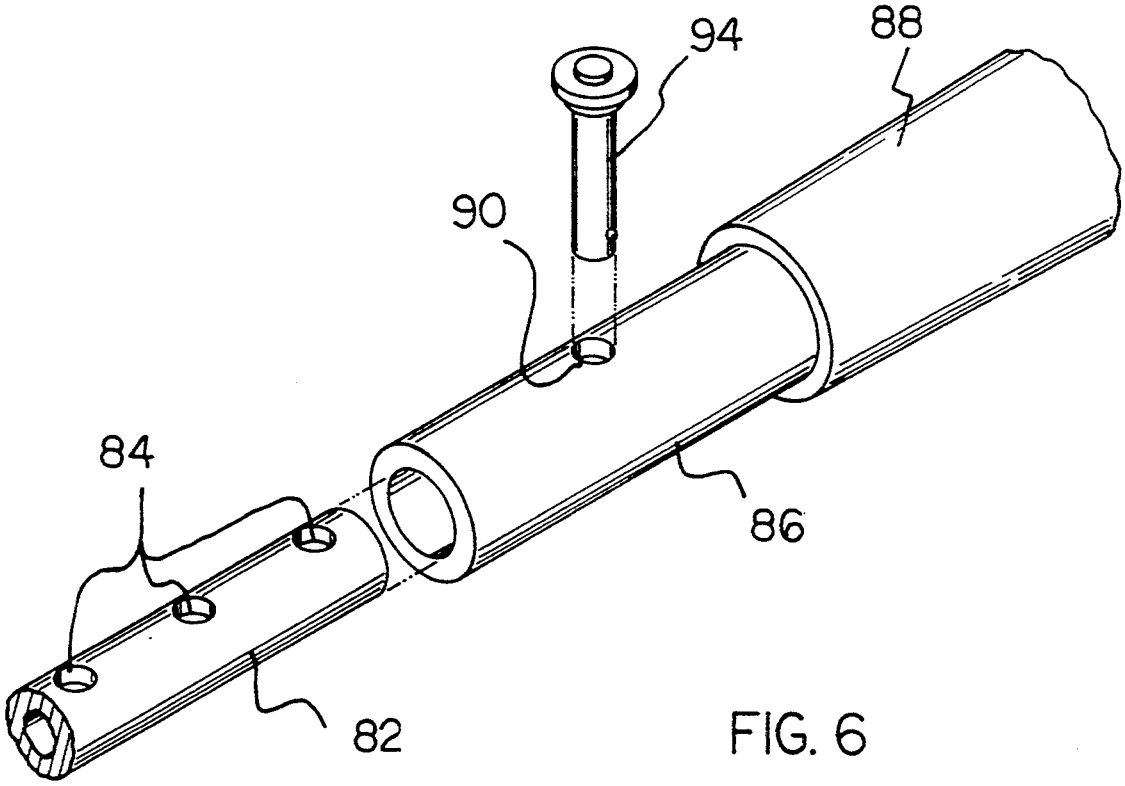
FIG. 6

GOLF CLUBS WITH QUICK RELEASE HEADS

BACKGROUND OF THE INVENTION

1. Field of the Invention

The present invention relates to golf clubs with quick release heads and more particularly pertains to readily changing the head on a golf club shaft.

2. Description of the Prior Art

The use of golf clubs with changeable heads is known in the prior art. More specifically, golf clubs with changeable heads heretofore devised and utilized for the purpose of changing the heads on golf clubs are known to consist basically of familiar, expected, and obvious structural configurations, notwithstanding the myriad of designs encompassed by the crowded prior art which has been developed for the fulfillment of countless objectives and requirements.

By way of example, in U.S. Pat. No. 3,893,680 to Franchi discloses a golf club with interchangeable heads.

U.S. Pat. No. 4,506,888 to Nardozzi discloses a golf putter with interchangeable shafts and heads.

U.S. Pat. No. 4,943,059 to Morell discloses a golf club having removable head.

U.S. Pat. No. 4,948,132 to Wharton discloses a golf club.

Lastly, U.S. Pat. No. 5,039,098 to Pelz discloses a golf club having an aligning and quick connect-disconnect coupling between the golf club shaft and club head.

In this respect, the golf clubs with quick release heads according to the present invention substantially departs from the conventional concepts and designs of the prior art, and in doing so provides an apparatus primarily developed for the purpose of readily changing the head on a golf club shaft.

Therefore, it can be appreciated that there exists a continuing need for new and improved golf clubs with quick release heads which can be used for readily changing the head on a golf club shaft. In this regard, the present invention substantially fulfills this need.

SUMMARY OF THE INVENTION

In view of the foregoing disadvantages inherent in the known types of golf clubs with changeable heads now present in the prior art, the present invention provides an improved golf clubs with quick release heads. As such, the general purpose of the present invention, which will be described subsequently in greater detail, is to provide a new and improved golf clubs with quick release heads and method which has all the advantages of the prior art and none of the disadvantages.

To attain this, the present invention essentially comprises a new and improved golf club with quick release head comprising a shaft having an upper handle end a lower hosel end formed in a tubular configuration, the hosel end having a bore centrally formed therein, screw threads formed within the bore extending from the hosel end of the shaft inwardly a predetermined distance. A head has a toe, heel, face, back and sole plate at the lower head end and has an upwardly extending hosel at the hosel end and a bore formed within the hosel end, the interior diameter of the bore of the hosel being essentially the same as the internal bore in the shaft and the exterior diameter of the hosel being essentially the same as the exterior diameter of the shaft at the hosel end, the hosel having a diametric aperture extending therethrough. A coupling rod has a threaded upper end with screw threads matable with the screw threads in the bore of the shaft and of a length not greater than the length of the threaded portion of the shaft and having a lower end formed with a diametric aperture extending therethrough in alignment with the diametric aperture in the hosel. A quick release pin is positionable through the apertures of the hosel and rod to secure a preselected head in operative association with the rod and shaft. The upper handle end of the shaft is formed with an interior shaft component with a plurality of diametric holes in axial alignment through one wall of the shaft and having a diametrically enlarged upper extent for receiving a grip, the upper extent having a single hole adapted to be aligned with a preselected one of the plurality of holes in the interior component and a supplemental quick release pin positioned through the apertures of the interior and exterior components at the upper end of the shafts. A spring pin extends through apertures in the shaft and the rod at a location to offset the diameter to ensure a proper rotational orientation between the shaft and the rod.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved golf clubs with quick release heads which have all the advantages of the prior art golf clubs with changeable heads and none of the disadvantages.

It is another object of the present invention to provide new and improved golf clubs with quick release heads which may be easily and efficiently manufactured and marketed.

It is further object of the present invention to provide new and improved golf clubs with quick release heads which are of durable and reliable constructions.

An even further object of the present invention is to provide new and improved golf clubs with quick release heads which are susceptible of a low cost of manufacture with regard to both materials and labor, and which accordingly are then susceptible of low prices of sale to the consuming public, thereby making such golf clubs with quick release heads economically available to the buying public.

Still yet another object of the present invention is to provide new and improved golf clubs with quick release heads which provide in the apparatuses and methods of the prior art some of the advantages thereof, while simultaneously overcoming some of the disadvantages normally associated therewith.

Still another object of the present invention is to readily change the head on a golf club shaft.

Lastly, it is an object of the present invention to provide new and improved a golf club with a quick release head comprising a shaft which has an upper handle end a lower hosel end formed in a tubular configuration. The hosel end has a bore centrally formed therein. Screw threads formed within the bore extend from the hosel end of the shaft inwardly a predetermined distance. A head at the lower head end has an upwardly extending hosel at the hosel end and a bore formed within the hosel end. The interior diameter of the bore of the hosel is essentially the same as the internal bore in the shaft and the exterior diameter of the hosel is essentially the same as the exterior diameter of the shaft at the hosel end. The hosel has a diametric aperture which extends therethrough. A coupling rod has a threaded upper end with screw threads matable with the screw threads in the bore of the shaft and a lower end formed with a diametric aperture extends therethrough in alignment with the diametric aperture in the hosel. A quick release pin is positionable through the apertures of the hosel and rod to secure a preselected head in operative association with the rod and shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective illustration of a golf club constructed with yet another alternate embodiment of the invention.

FIG. 6 is an enlarged exploded perspective illustration of a central portion of those components shown in FIG. 5.

DESCRIPTION OF THE PREFERRED EMBODIMENT

Figure 1:
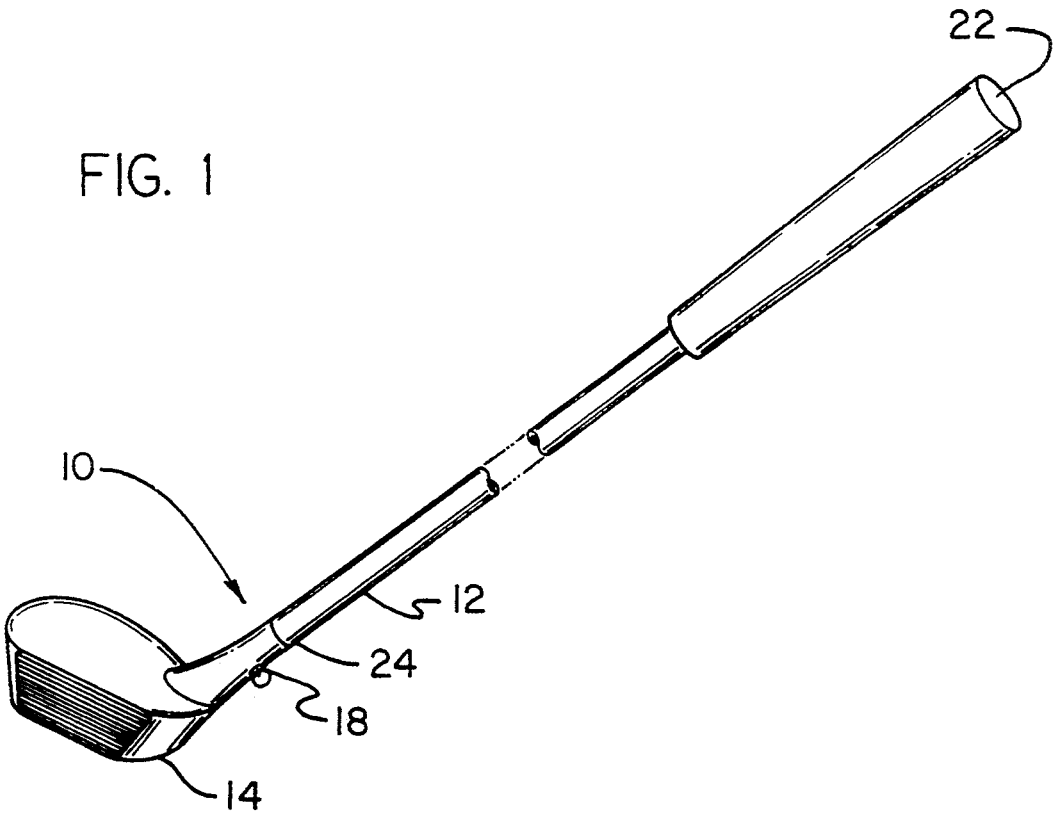
FIG. 1 is a perspective illustration of the preferred embodiment of the golf clubs with quick release heads constructed in accordance with the principles of the present invention.
Figure 2:
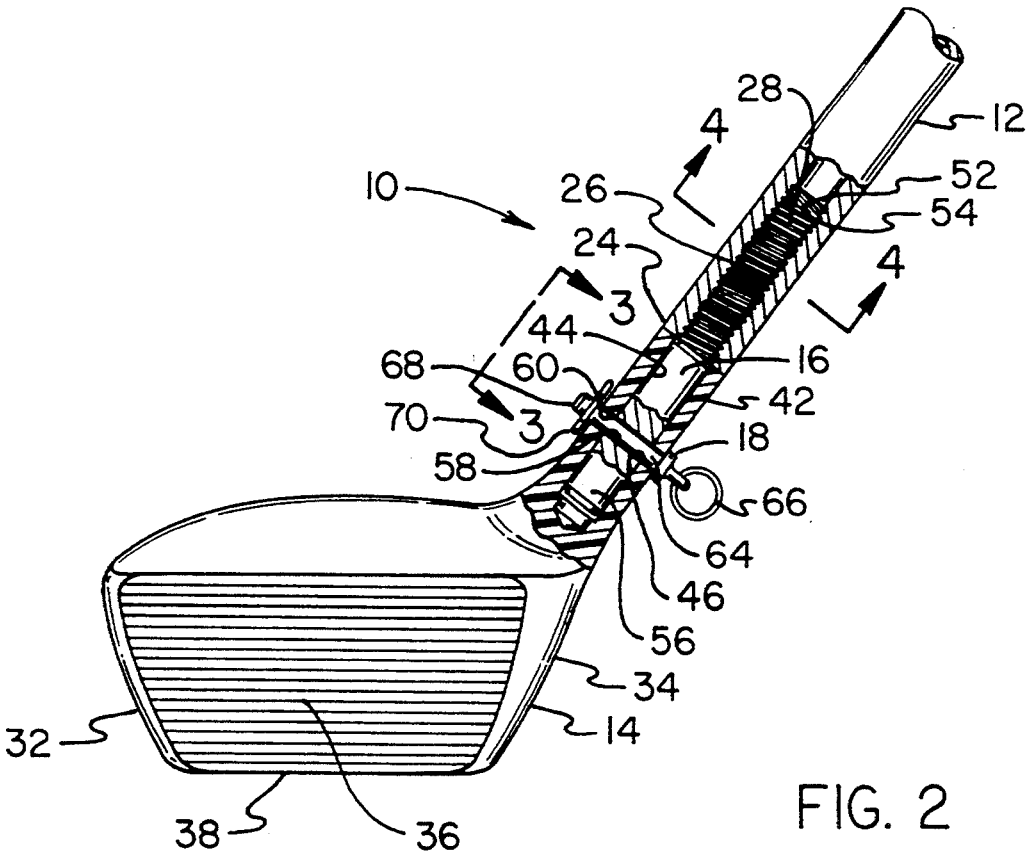
FIG. 2 is a front elevational view partly in section of the lower extent of the golf club shown in FIG. 1.
Figure 3:
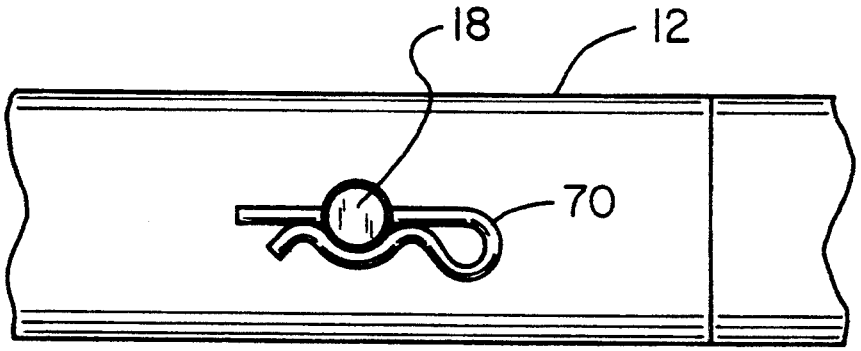
FIG. 3 is a side elevational view of the region of coupling between the shaft and the head taken along line 3—3 of FIG. 2.
Figure 4:
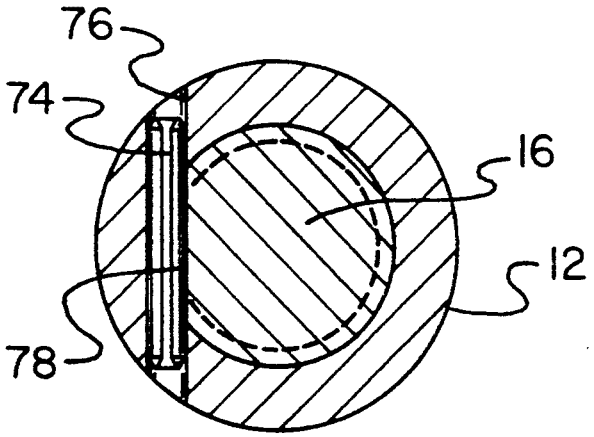
FIG. 4 is a cross sectional view taken along line 4—4 of FIG. 3.

With reference now to the drawings, and in particular to FIG. 1 thereof, the preferred embodiment of the new and improved golf clubs with quick release heads embodying the principles and concepts of the present invention and generally designated by the reference numeral 10 will be described.

Specifically, it will be noted with particular reference to FIGS. 1 through 4 that there is disclosed a new and improved golf club 10 with quick release heads. In its broadest context, the golf clubs 10 include a shaft 12, a head 14, a coupling rod 16, and a quick release pin 18. These parts are constructed and assembled so as to achieve the intended objective.

More specifically, the shaft 12 is fabricated to include an upper handle end 22 and a lower hosel end 24. The tube extending from end to end is in a generally tubular configuration. The hosel end 24 is formed with a bore 26. The bore is centrally formed therein. The bore is formed with screw threads 28 formed in the bore. The threads extend from the hosel end of the shaft inwardly, upwardly on the shaft, for a short predetermined distance.

The second major component of the golf club 10 is the head 14. As is conventional, the head includes a toe 32, a heel 34, a face 36 constituting a ball striking surface 36 and a sole plate 38. At the upper extent of the head is a hosel 38 extending upwardly at an appropriate plan angle. The hosel 42 is formed with axial bore 44 positionable in axial alignment with the bore of the shaft. The interior diameter of the bore of the hosel is essentially the same as the internal bore of the shaft. In addition, the exterior diameter of the hosel is essentially the same as the exterior diameter of the shaft at the hosel end. The hosel is also formed with diametric apertures 46 extending therethrough to facilitate the coupling therebetween.

The third major component of the golf club 10 is a coupling rod 16. The coupling rod 16 has a threaded upper end 52 formed with screw threads 54. The screw threads 54 of the coupling rod are matable with the screw threads in the bore at the lower end of the shaft. For proper coupling, the upper end of the coupling rod is of a length not greater than the length of the threaded portion of the shaft. It is preferably of a slightly shorter length for optimum coupling. Also formed into the coupling rod is a diametric aperture 58. The aperture extends through the lower end 56 of the coupling rod and is positionable in alignment with the diametric apertures 60 in the hosel.

The fourth major component of the golf club 10 is the quick release pin 18. The quick release pin is adapted to be positioned through the apertures 60 of the hosel and the aperture of the rod to secure a preselected golf club head 14 in operative association with the rod 16 and shaft 12. The quick release pin 18 is formed of mating cylindrical sections. A first cylindrical section 64 is of an enlarged diameter and includes an axial opening. Its free end includes a ring 66 to allow manipulation of the first end 64 of the quick release pin. The second component of the quick release pin is a cylindrical component 68 having an exterior diameter to fit within the first component 64. A cotter pin 70 couples the second component 68 of the pin 18 in a predetermined position. The construction of the pin is generally conventional in that it allows coupling of the components together for a securement therebetween. A pull on the ring 66 will allow axial movement of the first component with respect to the second component. This allows the pin to be separated and removed so that one club head 14 may be removed and replaced with an alternate club head as a function of the shot to be made by the player.

In order to maintain proper rotational alignment between the coupling rod 16 and shaft 12, a split type retaining pin 74 of the type having an axial spring is employed. Such retaining pin is positionable in an aperture 76 extending through the shaft adjacent to the hosel end. In association therewith, a recess 78 is formed in the coupling rod in alignment with the apertures 76. In this manner, with the apertures 76 and recess 78 the pin 74 may be slid into position to maintain the proper rotational relationship therebetween.

The upper end of the shaft is formed with an interior shaft component 82. Such interior shaft component has a plurality of diametric holes 84. Such holes are in axial alignment through one wall of the shaft. Also included is a diametrically enlarged upper extent 86 for receiving a grip 88. Such upper extent has a single hole 90. Such single hole is adapted to be aligned with a preselected one of the plurality of holes 84 which are in the interior shaft components. a supplemental quick release pin 94 is positioned through the aligned apertures of the interior shaft component and the exterior component at the upper handle end of the shaft. Such allows for varying the length of the shaft as a function of the club head utilized therewith.

Golf is one of the most popular sports in the world. At every course worldwide, golfers of all abilities can be found enjoying themselves with a good round. The enjoyment and challenge of plying well lures many people to golf each year. Controlling the club head throughout the swing is one of the key elements of a good golf game. Many experts would agree that the shaft has less of an impact on accuracy than does a good, basic swing. Yet, most clubs are still provided with a handle and shaft. This increases the overall weight of the set of clubs, and increases the initial cost of ownership. That is why the present invention has been conceived. The present invention employs a removable handle and shaft that fits an assortment of specially designed club heads.

The heart of the present invention is the interface between the shaft and the club head. The interface consists of the end of the shaft, a steel pin, the attachment point of the head, and a removable, hardened locking pin. The end of the shaft is hollow. It is threaded on its inside diameter to accept the steel pin, which is also threaded. The opposite end of the pin is round and smooth, and has a small hole drilled through its center across its axis. The pin is designed to be inserted into a similarly profiled hole within the club head, which has a smaller matching hole drilled through it. The locking pin is the method that allows the head to be securely attached to the shaft. It has a ½ inch diameter ring at one end, and a small hole at the other. The ring is used to pull the locking pin out of the club head, while the hole is used to accommodate a dedicated cotter pin. The pin is inserted through the club head, into the shaft, and out through the other side of the head. This arrangement ensures the rigidity of the connection and allows for the easy exchange of heads.

The present invention is significantly lighter and easier to carry than a bag full of conventional clubs. It also makes saving money while maintaining driving distance and accuracy a mutually beneficial endeavor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golf club with a quick release head comprising, in combination:

a shaft having an upper handle end and a lower hosel end formed in a tubular configuration, the hosel end having a bore centrally formed therein, screw threads formed within the bore extending from the hosel end of the shaft inwardly a predetermined distance;

a head having a toe, heel, face, back and sole plate at the lower head end and having an upwardly extending hosel at the hosel end and having a bore formed within the hosel end, the interior diameter of the bore of the hosel being essentially the same as the internal bore in the shaft and the exterior diameter of the hosel being essentially the same as the exterior diameter of the shaft at the hosel end, the hosel having a diametric aperture extending therethrough;

a coupling rod having a threaded upper end with screw threads mated with the screw threads in the bore of the shaft and a length not greater than the length of the threaded portion of the shaft and having a lower end formed with a diametric aperture extending therethrough in alignment with the diametric aperture in the hosel;

a quick release pin positioned through the apertures of the hosel and rod to secure a preselected head in operative association with the rod and shaft;

the upper handle end of the shaft being formed with an interior shaft component with a plurality of diametric holes in axial alignment through one wall of the shaft and having a diametrically enlarged upper extent for receiving a grip, the upper extent comprising an exterior component having a single hole adapted to be aligned with a preselected one of the plurality of holes in the interior shaft component and a supplemental quick release pin positioned through the apertures of the interior and exterior components at the upper handle end of the shaft; and a spring pin extending through apertures in the shaft and the rod at a location to offset the diameter to ensure a proper rotational orientation between the shaft and the rod.

2. A golf club with a quick release head comprising:

a shaft having an upper handle end and a lower hosel end formed in a tubular configuration, the hosel end having a bore centrally formed therein, screw threads formed within the bore extending from the hosel end of the shaft inwardly a predetermined distance;

a head at the lower head end and having an upwardly extending hosel at the hosel end and having a bore formed within the hosel end, the interior diameter of the bore of the hosel being essentially the same as the internal bore in the shaft and the exterior diameter of the hosel being essentially the same as the exterior diameter of the shaft at the hosel end, the hosel having a diametric aperture extending therethrough;

a coupling rod having a threaded upper end with screw threads mated with the screw threads in the bore of the shaft and having a lower end formed with a diametric aperture extending therethrough in alignment with the diametric aperture in the hosel; and a quick release pin positioned through the apertures of the hosel and rod to secure a preselected head in operative association with the rod and shaft.

3. The golf club as set forth in claim 2 wherein the upper handle end of the shaft being formed with an interior shaft component with a plurality of diametric holes in axial alignment through one wall of the shaft and having a diametrically enlarged upper extent for receiving a grip, the upper extent comprising an exterior component having a single hole adapted to be aligned with a preselected one of the plurality of holes in the interior shaft component and a supplemental quick release pin positioned through the apertures of the interior and exterior components at the upper handle end of the shaft.

4. The golf club as set forth in claim 2 and further including:

a spring pin extending through apertures in the shaft and the rod at a location to offset the diameter to ensure a proper rotational orientation between the shaft and the rod.

* * * * *